United States Patent [19]

Fontaine et al.

[11] Patent Number: 4,884,525

[45] Date of Patent: Dec. 5, 1989

[54] SINGLE OR TWO-SIDED GALVANIZING PLANT

[75] Inventors: Paul Fontaine, Ermlandstr. 45, D-4018 Langenfeld; Klaus Frommann, Meerbusch; Rolf Michel, Drensteinfurt, all of Fed. Rep. of Germany

[73] Assignee: Paul Fontaine, Langenfeld, Fed. Rep. of Germany

[21] Appl. No.: 177,545

[22] PCT Filed: Jul. 29, 1987

[86] PCT No.: PCT/EP87/00410

§ 371 Date: Mar. 14, 1988

§ 102(e) Date: Mar. 14, 1988

[87] PCT Pub. No.: WO88/00983

PCT Pub. Date: Feb. 11, 1988

[30] Foreign Application Priority Data

Jul. 30, 1986 [DE] Fed. Rep. of Germany ..... 3625680

[51] Int. Cl.[4] ..... B05C 11/00

[52] U.S. Cl. ..... 118/65; 118/63; 118/419; 118/429; 427/433; 427/434.3

[58] Field of Search ..... 118/65, 419, 429, 206, 118/63; 427/433, 434.3

[56] References Cited

U.S. PATENT DOCUMENTS

| | | | |
|---|---|---|---|
| 3,643,627 | 2/1972 | Killin et al. | 118/419 X |
| 4,374,873 | 2/1983 | Piedboeuf et al. | 427/433 X |
| 4,408,561 | 10/1983 | Yokoyama et al. | 118/419 X |
| 4,446,812 | 5/1984 | Wang | 118/419 X |

FOREIGN PATENT DOCUMENTS

| | | |
|---|---|---|
| 0064922 | 11/1982 | European Pat. Off. . |
| 0072874 | 3/1983 | European Pat. Off. . |
| 3313218 | 10/1984 | Fed. Rep. of Germany . |
| 58-81960 | 5/1983 | Japan . |

OTHER PUBLICATIONS

Patent Abstracts of Japan, vol. 7, No. 175, (c179) (1320), 8/3/83, Abstract-8 JP, A, 588/960, 5/17/83.

*Primary Examiner*—Shrive Beck
*Assistant Examiner*—Alain Bashore
*Attorney, Agent, or Firm*—Renner, Otto, Boisselle & Sklar

[57] ABSTRACT

The invention relates to an installation for zinc coating one or both sides of continuous steel strip. In order to retain short change-over times when changing from one process to the other, the invention proposes to flange-mount in readily releasably manner a housing (*2a, 2b*), with guide rolls (*3a, 3b*) mounted therein, on the duct (5) leading from the furnace to the zinc bath and to design this housing so that it can be interchanged with a support for the guide roll (10) during two-sided zinc coating, making use of the mounting at the duct (5).

14 Claims, 1 Drawing Sheet

SINGLE OR TWO-SIDED GALVANIZING PLANT

DISCLOSURE

The invention relates to an installation for zinc coating or galvanizing one or both sides of a continuous flow of steel strip which, through a duct in which a protective gas atmosphere prevails and which is connected to the furnace, is directed to a vessel filled with liquid zinc and where, for the purpose of bilateral zinc coating, it is guided around a deflector or guide roll disposed within the zinc bath and, optionally, stabilising rolls or, for the purpose of unilateral zinc coating, it is directed around at least one deflector or guide roll, which is disposed above the surface of the zinc bath inside a housing flange-mounted in gas-tight manner on the duct, in the same direction as with bilateral zinc coating, the guide roll being associated with a coating roll immersed in the zinc bath.

BACKGROUND

The constantly increasing demand in the last few years for steel strip which has been zinc-coated on one side, in particular for processing as car body sheet, has resulted in a greater need for installations which can produce strip of this type. However, since there is still a considerable demand for bilaterally galvanized steel strip, modern coating installations should be able to produce both types of coated strip, wherein the conversion from one-sided to two-sided coating should take place as rapidly as possible and at low cost.

An installation for one-sided and two-sided coating has been proposed (DE-A 33 13 218), of the type described above. This installation enables both one-sided and two-sided coating to be carried out satisfactorily but the change-over from one process to the other means that the installation has to undergo a series of conversion measures which are very costly in respect of labour and time. Moreover, a substantial break in production has to be taken into account since no treatment of the strip can carried out at that time.

It has also been already proposed (EP-A 0 064 922) to develop an installation for one and two-sided zinc coating in such a way that by conveying and pivoting a wide variety of installation components it is possible to carry out both process stages with the same installation. However, this installation has the disadvantage of very complex mechanical and kinematic mechanisms which, in the event of breakdowns, result in even longer installation down-times and production stoppages. This also applies when parts of the installation have to be maintained, replaced or cleaned.

SUMMARY OF THE INVENTION

Starting from the known state of the art, it is the object of the invention to devise an installation for zinc coating one or both sides of a continuous flow of steel strip, which is of simple construction but allows a rapid change-over of the installation from one process to the other, even with the strip material in place.

To achieve this object it is proposed, according to the invention, that the flanged connection between the duct and the housing can be readily released and in the course of two-sided zinc coating the housing can be replaced by a support for the guide roll, the mounting of which corresponds to that of the housing.

Therefore, the basis of the invention is the interchange of complete "kits" for one-side and two-sided zinc coating, each "kit" including in fully prepared form the components required for the respective process stages.

According to another advantageous feature of the invention, it is proposed to effect the mounting via a housing part which is arranged on the support and which encloses the strip on three sides and is open both towards the duct and the zinc bath, in which the lower zone of the housing part is immersed. In this way, firstly the required gas-tight connection is assured between the duct leading out of the furnace and the zinc bath and, secondly, it is ensured that the part of the installation intended for two-sided zinc coating can be withdrawn without cutting the strip. According to a further feature of the invention, another solution has the same aim and provides for the housing to be in two parts and for the plane of separation of the housing parts to extend along the plane of the outgoing strip. By separating both housing parts it is possible for them to be removed easily from either side of the strip, in which case according to another feature of the invention the guide roll or rolls are mounted preferably in one part of the housing and in the other part of the housing a nozzle blade, for equalising the coating thickness, is arranged so as to be detachable respectively with the housing parts.

Preferably, the coating roll is mounted on a lever arm pivotably supported outside the housing. It is advantageous if the lever arm is provided with the bearing for a stabilising roll during two-sided zinc coating, which can be exchanged for the coating roll for one-sided zinc coating. The installation can be simplified thereby, so that only the rolls have to be changed and the other mechanical components remain in the installation.

According to a particularly preferably feature, the flange of the flanged connection with the duct is arranged to extend approximately perpendicular to the plane of the bath surface and transversely to the strip, and extends into the zinc bath. The gas-tight seal of the housing or support respectively is assured in this way, in which case with a flange-mounted support the housing part disposed there is left downwardly open so that it can be withdrawn upwards without it being necessary to remove the strip.

One embodiment of the invention is illustrated by way of example in the drawings and will be described below, wherein:

DETAILED DESCRIPTION

Figure 1:
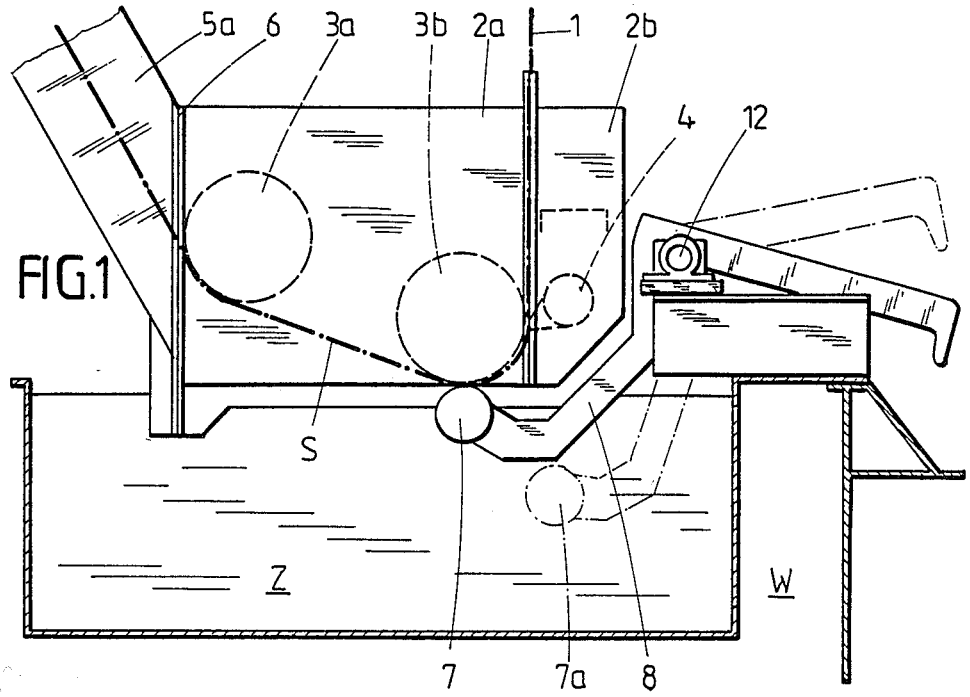
FIG. 1 shows a cross-section through the installation according to the invention for one-sided zinc coating.
Figure 2:
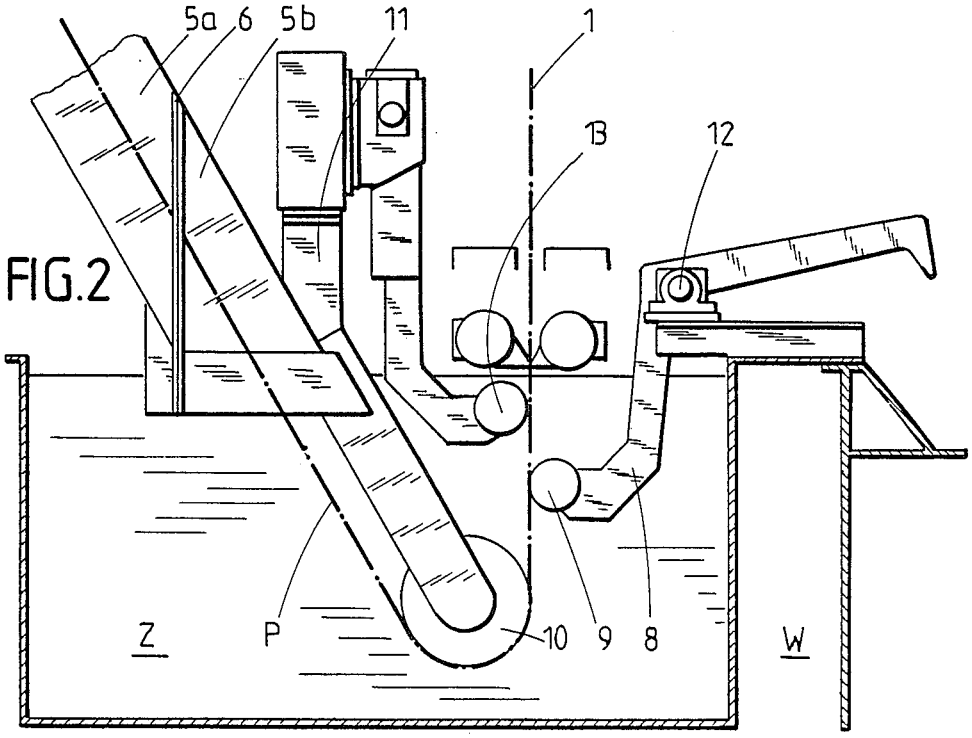
FIG. 2 shows a cross-section through the installation for two-sided zinc coating.

FIG. 1 shows a trough W which contains liquid zinc. Above the trough W and the zinc bath there is illustrated the apparatus for coating one-side of a strip designated S; the apparatus comprises a housing 2*a*, 2*b*, the lower part of which is immersed in the zinc Z and in which are mounted guide rolls 3*a*, 3*b* and a nozzle blade 4 or an air knife nozzle. A coating roll 7, which is disposed at the free end of a lever 8, is swung from below against the strip S in the vicinity of the guide roll 3*b*. The lever 8 is pivotable about an pivot point 12 into a position in which the coating roll is situated in a retracted position 7*a*. The housing 2*a*, 2*b*, comprises two parts, 2*a* and 2*b*, flange-mounted against one another, the joint separating the two housing parts 2a, 2b lying in the plane of the outgoing strip S, which is denoted by the reference numeral 1. On the left-hand side, with respect to the drawing plane, the housing 2a is adjoined by a flange 6 to a duct 5 and is connected thereto. The flange 6 extends perpendicularly to the surface of the zinc Z and projects into the zinc bath. The flanged connection is gas-tight, as is the entire housing 2a, 2b which is closed off downwardly by the zinc bath.

If the installation is to be used for zinc coating both sides of a continuous steel strip S, after loosening the flanged connection 6 and separating the housing parts 2a, 2b together with the guide rolls 3a, 3b mounted therein and the nozzle blade 4, the housing 2a, 2b is removed and replaced by a support 11 on which a stabilising roll 13, a guide roll 10 and a housing part 5b are mounted. The coating roll 7 on the arm 8 is replaced by a stabilising roll 9 and it is brought into the corresponding required position relative to the strip P by swinging the arm 8 about the pivot point 12.

The housing part 5b disposed on the support 11 forms an extension of the duct 5 which leads from the furnace into the zinc Z. Because of the position of the flanged connection perpendicular to the zinc bath and because the lower duct boundary extends into the liquid zinc, the housing 5b is so formed that it surrounds the strip on three sides and the enclosed space is closed off gas-tightly on one side with respect to the liquid zinc Z and by the flange-mounting at 6 with respect to the duct 5. The flange-mounting 6 is identical to the connection with the housing 2a, 2b, so that both parts can be interchanged with one another in modular manner. The design of both installation components is such that the strip P can remain in the installation while the change from one-side to two-sided zinc coating is being carried out.

The invention makes possible a rapid change from one process to the other, while the cost of the installation components used is kept low and by changing complete "kits" maintenance and repairs to the particular installation component not in use can be carried out advantageously outside the installation so as to ensure that the correspondingly prepared components can be re-used within the shortest time possible.

What is claimed is:

1. An installation for zinc coating a continuous supply of steel strip which installation is operable in a first mode for coating one side of said steel strip and is operable in a second mode for coating both sides of said steel strip, said installation comprising a vessel to contain liquid zinc above a predetermined level; and interchangeable first and second coating units for use in respective said first and second modes of operation, said first coating unit comprising means for use in coating one side only of a continuous steel strip with said liquid zinc, said second coating unit comprising means for use in coating both sides of a continuous steel strip with said liquid zinc, each said coating unit including a mounting flange whereby the units are adapted to be interchangeably readily connected in a gas tight manner to and disconnected from a corresponding flange to be provided on a duct for the supply of steel strip in an inert gas atmosphere from a furnace in use, each said coating unit being removable without cutting said continuous steel strip, and said mounting flange of each unit when connected to the flange of the duct projecting downwardly below said predetermined level in said vessel whereby the connection between said mounting flange and the duct flange will be closed at its lower end by said liquid zinc.

2. An installation as claimed in claim 1, wherein the second coating unit comprises a duct member adapted to surround the steel strip on three sides and being open downwardly, the duct member having a lower margin for immersion in liquid zinc in the vessel in use, and having an open end on which the said mounting flange is provided.

3. An installation as claimed in claim 1, wherein the first coating unit comprises a housing member incorporating the respective said mounting flange and having a lower margin for immersion in said liquid zinc bath in use, said housing member enclosing the said means for use in coating one side of the steel strip.

4. An installation as claimed in claim 3, wherein the housing member is divided into two parts along a plane of division, and wherein said first coating unit comprises means defining a path for said steel strip through the first coating unit, said path including a portion by which the path exits said housing member, which exit portion lies in said plane.

5. An installation as claimed in claim 3, further including means defining a path for the continuous passage of steel strip including guide means in said housing defining the lowest point in said path around which guide means steel strip passes continuously in use, which guide means is to be above the molten zinc in said vessel in use, said installation further including a coating roller adjacent and below said guide means so as to be in said molten zinc in use and disposed so as to contact a lower surface of said steel strip in use.

6. An installation as claimed in claim 5, wherein the said housing member is divided into two parts along a plane of division and wherein said path for steel strip includes a portion by which the path exits said housing member, which exit portion lies in said plane.

7. An installation as claimed in claim 6, wherein said guide means is mounted within one said part of said housing member and means for equalizing the thickness of a coating of molten zinc on one side of said steel strip is provided in the other said part of said housing member so that said guide means is removable with the said one housing member part and said equalizing means is removable with the said other housing member part.

8. An installation as claimed in claim 5, wherein said coating roller is mounted outside of said housing member on a pivotable lever arm.

9. An installation as claimed in claim 8, wherein said installation includes, for use with said second coating unit, a stabilizing roller for abutting the steel strip within the liquid zinc in use, which stabilizing roller is mountable on said pivotable lever arm in substitution for said coating roller.

10. An installation as claimed in claim 1, wherein in use the mounting flanges of each of the first coating unit and the second coating unit each extend substantially vertically and extend into said vessel to be below the surface of the liquid zinc.

11. An installation as claimed in claim 1, wherein said second coating unit includes a support means bearing said mounting flange of the second coating unit and guide means carried by said support means to be positioned within said vessel to direct the steel strip below the surface of the liquid zinc therein in use.

12. An installation for zinc coating a continuous supply of steel strip which installation is operable in a first mode for coating one face of said steel strip and is operable in a second mode for coating both faces of said steel strip, said installation comprising:

a vessel to contain liquid zinc above a predetermined level; and interchangeable first and second coating units for use in respective said first and second modes of operation, said first coating unit comprising:

a housing member to be mounted above said vessel so as to extend down into said vessel and having a mounting flange whereby said housing member is adapted to be readily connected in a gas tight manner to and disconnected from a corresponding flange to be provided on a duct for the supply of steel strip in an inert atmosphere from a furnace in use, said mounting flange of said housing member when connected to the flange of the duct projecting downwardly below said predetermined level in said vessel whereby the connection between said mounting flange and the duct flange will be closed at its lower end by said liquid zinc; and means defining a path for the continuous passage of steel strip including guide means in said housing member defining the deepest point of said path, which guide means is to be above the molten zinc in said vessel in use; and said installation further comprising a coating roller operable with said first coating unit in a position adjacent and below said guide means so as to be in said molten zinc in use; and said second coating unit comprising:

a duct member for the passage of steel strip into the installation, said duct member having an outlet end for positioning within said vessel and an inlet end provided with a mounting flange whereby said housing is adapted to be readily connected in a gas tight manner to and disconnected from said corresponding flange to be provided on a duct for the supply of steel strip in an inert atmosphere from a furnace in use, said mounting flange of said duct member when connected to the flange of the duct projecting downwardly below said predetermined level in said vessel whereby the connection between said mounting flange and the duct flange will be closed at its lower end by said liquid zinc; and guide means connected to said duct member for defining the deepest point within the vessel of a path into and out of molten zinc in the vessel for the continuous passage of steel strip.

13. Apparatus for galvanizing steel strip comprising:

a furnace for heating steel strip to be galvanized;

an outlet duct for steel strip from said furnace terminating in a mounting flange;

means for maintaining an inert atmosphere in said duct;

a vessel for containing liquid zinc above a predetermined level; and interchangeable first and second coating units for use in respective first and second modes of operation, said first coating unit comprising means for coating one side only of a continuous steel strip with said liquid zinc and said second coating unit comprising means for coating both sides of a continuous steel strip with said liquid zinc, wherein each said coating unit includes an enclosure member incorporating a mounting flange whereby the units are adapted to be interchangeably readily connected in a gas tight manner to and disconnected from the flange provided on the duct for the supply of steel strip in an inert gas atmosphere from the furnace, said mounting flange of each said coating unit when connected to the flange of the duct projecting downwardly below said predetermined level in said vessel whereby the connection between said mounting flange and the duct flange will be closed at its lower end by said liquid zinc, each said enclosure member being adapted to enclose said steel strip from its entering the respective coating unit until after it has been coated with zinc, and said second coating unit including support means carrying the enclosure member of the second coating unit and carrying guide means for said steel strip to be positioned within said vessel below the surface of the liquid zinc in use.

14. An installation as claimed in claim 1, wherein said means for use of each said coating unit includes means for defining a respective path along which said steel strip is guided, each said path being open in a direction opposite a removal direction of the unit thereby enabling interchangeability of said coating units without interrupting or removing said steel strip.

* * * * *